US006668873B1

(12) United States Patent
Wertheim

(10) Patent No.: US 6,668,873 B1
(45) Date of Patent: Dec. 30, 2003

(54) TAMPER-PROOF CHEMICAL DISPENSING DEVICE FOR HIGH SECURITY ENVIRONMENTS

(75) Inventor: Mark S. Wertheim, Danville, CA (US)

(73) Assignee: Keene Sanitary Supply, Inc., San Ramon, CA (US)

( * ) Notice: Subject to any disclaimer, the term of this patent is extended or adjusted under 35 U.S.C. 154(b) by 0 days.

(21) Appl. No.: 10/216,017

(22) Filed: Aug. 9, 2002

Related U.S. Application Data

(63) Continuation of application No. 09/828,554, filed on Apr. 5, 2001, now Pat. No. 6,439,272.
(60) Provisional application No. 60/262,733, filed on Jan. 19, 2001, and provisional application No. 60/194,811, filed on Apr. 5, 2000.

(51) Int. Cl.[7] ..... B65B 1/04
(52) U.S. Cl. ..... 141/2; 141/18; 141/9; 141/100; 222/538
(58) Field of Search ..... 141/2, 18, 98, 141/9, 100, 104, 94; 222/538, 132, 145.1, 145.4, 145.5, 129, 135, 153.01, 153.02, 153.03, 153.13, 153.14, 173, 182, 183, 540, 566, 572, 573, 575

(56) References Cited

U.S. PATENT DOCUMENTS

| | | | |
|---|---|---|---|
| 932,386 | A | 8/1909 | Gross |
| 1,075,999 | A | 10/1913 | Abramovitz |
| 1,291,566 | A | 1/1919 | Lewis |
| 1,366,529 | A | 1/1921 | Frick |
| 1,421,765 | A | 7/1922 | Cunningham |
| 1,715,939 | A | 6/1929 | Milestone |
| 2,000,556 | A | 5/1935 | Brady |
| 2,063,171 | A | 12/1936 | Kucher |
| 2,512,395 | A | 6/1950 | Sundeberg |
| 2,572,541 | A | 10/1951 | Thompson et al. |
| 2,643,669 | A | 6/1953 | Logan |
| 3,127,065 | A | 3/1964 | Stevenson |
| 3,195,777 | A | 7/1965 | Hart |
| 3,861,568 | A | 1/1975 | Morris et al. |
| 3,940,019 | A | 2/1976 | Kross et al. |
| 3,945,603 | A | 3/1976 | Fraser |
| 4,120,181 | A | 10/1978 | Stubbings |

(List continued on next page.)

FOREIGN PATENT DOCUMENTS

| | | |
|---|---|---|
| DE | 2558569 | 5/1976 |
| GB | 2173347 A | 10/1976 |
| GB | 2173476 A | 10/1976 |

OTHER PUBLICATIONS

Aurora Laboratories, Inc. (2001). *Secure Dispensing Units.* Retreived Mar. 14, 2003 from http://www.auroralaboratories.com/secure.html.

(List continued on next page.)

*Primary Examiner*—Steven O. Douglas
(74) *Attorney, Agent, or Firm*—Thomas F. Lebens; Fitch, Even, Tabin & Flannery

(57) ABSTRACT

The present invention can be characterized as a tamper proof apparatus for dispensing liquid or cleaning product for use in a environment where abuse or vandalism may occur and a method of operating the apparatus. The apparatus includes a first chamber, a second chamber coupled to the first chamber, a first lockable door recessed within one of the first chamber and the second chamber such that a first hinge pin is not removable, a mixing unit within the first chamber. An output hose in one of the first chamber and the second chamber is coupled to the mixing unit and to a feed-through such that the output hose is not exposed outside the chambers. A faceplate with an indentation within the first chamber prevents filling large containers with liquid while also preventing damage to the mixing unit.

78 Claims, 6 Drawing Sheets

U.S. PATENT DOCUMENTS

| | | | | |
|---|---|---|---|---|
| 4,158,426 | A | | 6/1979 | Frohbieter |
| 4,452,371 | A | * | 6/1984 | Jurek ..... 220/315 |
| 4,911,212 | A | | 3/1990 | Burton |
| 5,060,689 | A | | 10/1991 | Csaszar et al. |
| 5,064,097 | A | | 11/1991 | Brog et al. |
| 5,088,621 | A | | 2/1992 | Thompson et al. |
| 5,255,820 | A | | 10/1993 | Thomas |
| 5,333,467 | A | | 8/1994 | Pearl, II et al. |
| 5,344,074 | A | | 9/1994 | Spriggs et al. |
| 5,351,875 | A | | 10/1994 | Rhine et al. |
| 5,584,327 | A | | 12/1996 | Thomas et al. |
| 5,651,398 | A | | 7/1997 | Decker et al. |
| 6,302,163 | B1 | | 10/2001 | Zeigler |
| 6,439,272 | B1 | | 8/2002 | Wertheim |

OTHER PUBLICATIONS

Aurora Laboratories, Inc. Product Bulletin. *Micro–Clean Security Cabinent,* (No date).

Aurora Laboratories, Inc. Product Bulletin. *Micro–Clean System,* (No date).

Aurora Laboratories, Inc. Product Invoice. Invoice No. 051310. Jan. 26, 1999.

Knight, Inc. (1998). Product Catalog. *Proportioning Systems*.

Knight LLC. (2001). Retreived Mar. 14, 2003 from http://www.knightequip.com/index.htm.

Hydro Systems Co. (1997). Proportioning and Dispensing Systems.

Hydro Systems Co. *Products.* Retreived Mar. 14, 2003 from http://www.hydrosystemsco.com/homeq.htm.

Hydro Systems Co. Product Catalog. *Proportioning and Dispensing Systems.* p. 1, (No date).

DEMA Engineering. *Chemical Dispensers.* Retreived Mar. 14, 2003 from http://demaeng.com/chemDisp.html.

DEMA Engineering Company. Company Bulletin, (No date).

DEMA Engineering Product Catalog. *Lockable Blend Safe.* p. 6, (No date).

Dilution Control Chemicals & Systems Product Catalog. *Waxie Solution Station.* p. 9 (No date).

Dilution Control Chemicals & Systems Product Catalog. *Butcher's Command Center.* p. 16, (No date).

U.S. Chemicals Corporation. *One Shot Cleaners Product Application Guide.* 2002.

Brightwell Product Summary. *Chemical Concentrate Dispensers.* May 2002.

Champion Chemical Co., *Janitorial Product Line.* Whittier, CA., (No Date).

Photographs of Secure Chemical Dispensers by Champion Chemical Co., Whittier, CA. (No date).

3M Product Brochure. CompuBlend II cleaning chemical management System, (No date).

Keene Sanitary Supply Cleaning Map. *Cell and Second Tier Cleaning.,* (No date).

Keene Sanitary Supply Product Brochure. *OPS Boxx Maximum Security Dispenser System,* (No date).

Keene Sanitary Supply Product Brochure. *OPS Dial–A–Color Cleaning Solution Dispensing System,* (No date).

Keene Sanitary Supply Product Brochure. *OPS Dial–A–Color Squeeze–N–Go Supreme,* (No date).

Keene Sanitary Supply, Inc. v. Champion Chemical Company of California, Inc., U.S. District Court For The Central District Of California. Case No. 028148 TJH (Cwx). *Declaration of Mike Jean in Opposition to Plaintiff's Motion for Preliminary Injunction.* Mar. 6, 2003.

Keene Sanitary Supply, Inc. v. Champion Chemical Company of California, Inc., U.S. District Court For The Central District Of California. Case No. 028148 TJH (Cwx). *Declaration of David Ellis in Opposition to Plaintiff's Motion for Preliminary Injuntion.* Mar. 6, 2003.

Keene Sanitary Supply, Inc. v. Champion Chemical Company of California, Inc., U.S. District Court For The Central District Of California. Case No. 028148 TJH (Cwx). *Declaration of Frank Winslow.* Mar. 11, 2003.

Keene Sanitary Supply, Inc. v. Champion Chemical Company of California, Inc., U.S. District Court For The Central District Of California. Case No. 028148 TJH (Cwx). *Defendant Champion's Evidentiary Objections to the Declaration of Mark S. Wertheim Injunction.* Mar. 10, 2003.

Keene Sanitary Supply, Inc. v. Champion Chemical Company of California, Inc., U.S. District Court For The Central District Of California. Case No. 028148 TJH (Cwx). *Memorandum of Points and Authorities in Opposition to Plaintiff's Motion for Preliminary Injunction.* Mar. 10, 2003.

Photographs of mixing nozzle by Advance Chemical Company, Huntington Beach, CA (No date).

* cited by examiner

TAMPER-PROOF CHEMICAL DISPENSING DEVICE FOR HIGH SECURITY ENVIRONMENTS

This patent application is a continuation of U.S. patent application Ser. No. 09/828,554, filed Apr. 5, 2001 U.S. Pat. No. 6,439,272, entitled TAMPER-PROOF CHEMICAL DISPENSING DEVICE FOR HIGH SECURITY ENVIRONMENTS, which claimed priority to U.S. Provisional Application No. 60/262,733 filed Jan. 19, 2001, and No. 60/194,811 filed Apr. 5, 2000. This patent application relates to and expressly incorporates herein by reference U.S. Provisional Patent Application No. 60/262,733 for TAMPER-PROOF CHEMICAL DISPENSING DEVICE FOR HIGH SECURITY ENVIRONMENTS, by Wertheim, filed Jan. 19, 2001, and U.S. Provisional Patent Application No. 60/194,811, for TAMPER-PROOF CHEMICAL DISPENSING DEVICE FOR HIGH SECURITY ENVIRONMENTS, by Wertheim, filed Apr. 5, 2000.

BACKGROUND OF THE INVENTION

The present invention is directed to methods and apparatus for dispensing liquids, and more particularly is directed to dispensing liquid from a tamper proof container. More specifically the present invention relates to dispensing cleaning products from a tamper proof container suitable for use in jail, correctional facility, school, public facility, or any other location subject to abuse or vandalism.

Liquid and soap dispensers have been used for many years. These dispensers are used in a number of applications, including: soap dispensers in restrooms, beverage dispensers, liquid dispensers at gas stations, etc. For example U.S. Pat. No. 4,911,212 discloses a device used to dispense water or other liquids into a reusable container. U.S. Pat. No. 5,088,621 discloses a dispenser to be used at a gas station. The '621 patent discloses an apparatus used to dispense a predetermined amount of liquid from a reservoir mounted on the dispenser. These devices although suitable in many applications do not provide a tamper proof dispenser.

Therefor there is a need for a tamper proof dispenser that can be used in correctional facilities, prisons, jails, public restrooms, schools and other facilities or institutions where the dispenser is susceptible to abuse or vandalism.

SUMMARY OF THE INVENTION

The present invention can be characterized as a tamper proof apparatus for dispensing liquid comprising a first chamber, a second chamber coupled to the first chamber, a first lockable door recessed within one of the first chamber and the second chamber such that a first hinge pin is not removable, a mixing unit within the first chamber, a water supply hose coupled to the mixing unit, a first concentrate supply hose coupled to the mixing unit, and an output hose in one of the first chamber and the second chamber coupled to the mixing unit and to a feed-through such that the output hose is not exposed outside the chambers.

The present invention also can be characterized as a method of dispensing liquid from a dispensing unit comprising supplying a mixing unit with water through a water supply hose, the mixing unit being stored in a first chamber, supplying a mixing unit with concentrate through a concentrate supply tube, the concentrate being stored in a second chamber, mixing the water and the concentrate within a mixing unit to form a liquid mixture and dispensing the liquid mixture through an output supply hose into a container, the output supply hose being coupled to a feed-through in the dispensing unit such that the output supply hose is not accessible from the outside of the dispensing unit.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
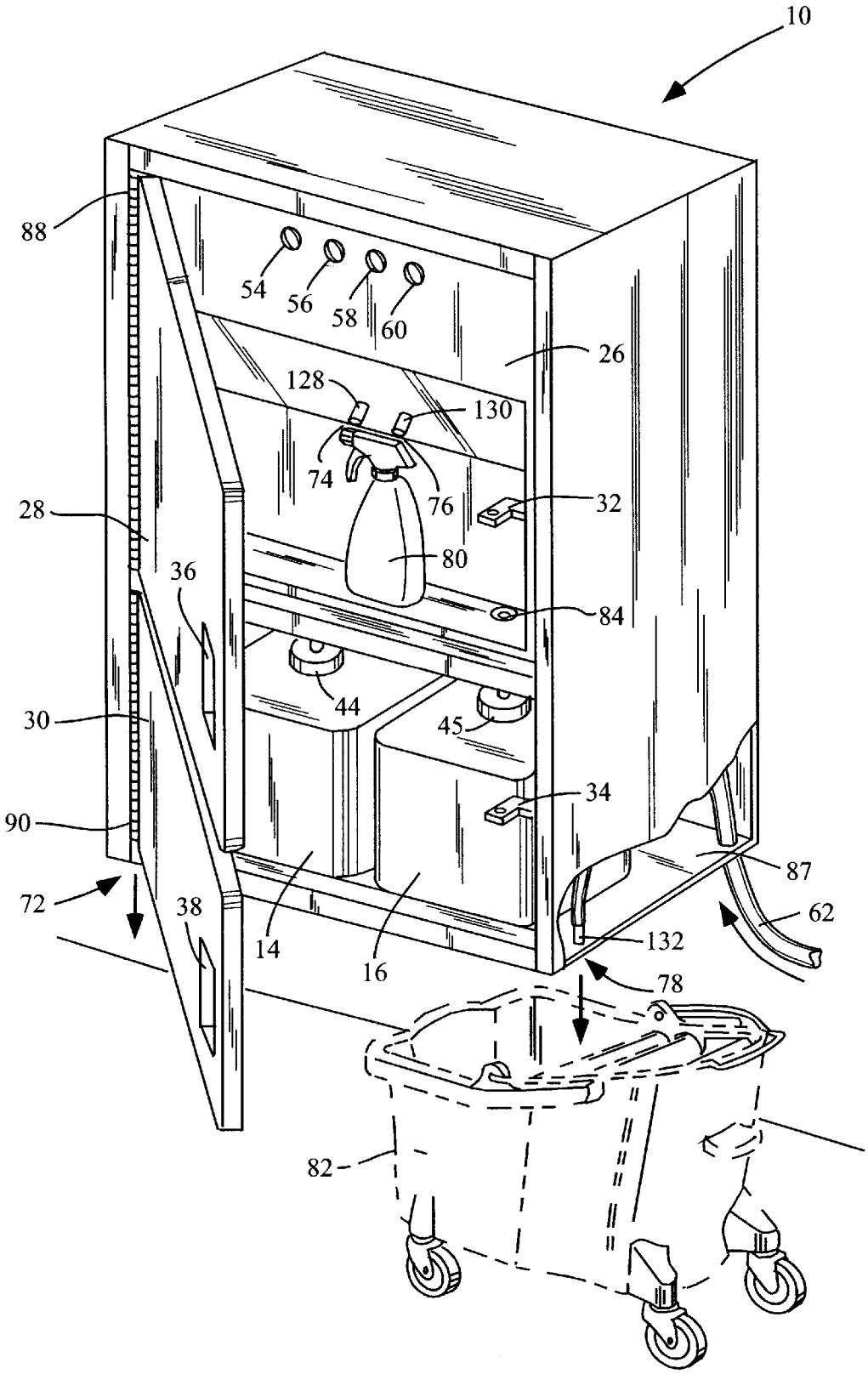
FIG. 1 is a perspective view of a dispensing unit for use with soap and other cleaning or chemical materials.

Referring first to FIG. 1 shown is a dispensing unit 10 for use with soap and other cleaning or chemical materials. Shown is a dispensing unit 10, a first concentrate supply reservoir 14, a second concentrate supply reservoir 16, a water supply hose 62, an upper lockable door 28, a lower lockable door 30, a first outlet 72, a second outlet 74, a third outlet 76, a fourth outlet 78, a second metal feed-through 128, a third metal feed-through 130, a fourth metal feed-through 132, a fourth output hose 70, an upper hasp 32, a lower hasp 34, a faceplate 26, a first button 54, a second button 56, a third button 58, a fourth button 60, a drain hole 84, a mop bucket 82, an upper hinge 88, a lower hinge 90, a base 87, a first recessed cavity 36, a second recessed cavity 38, a first concentrate supply cap 44, a second concentrate supply cap 45, and a spray bottle or container 80.

Figure 2:
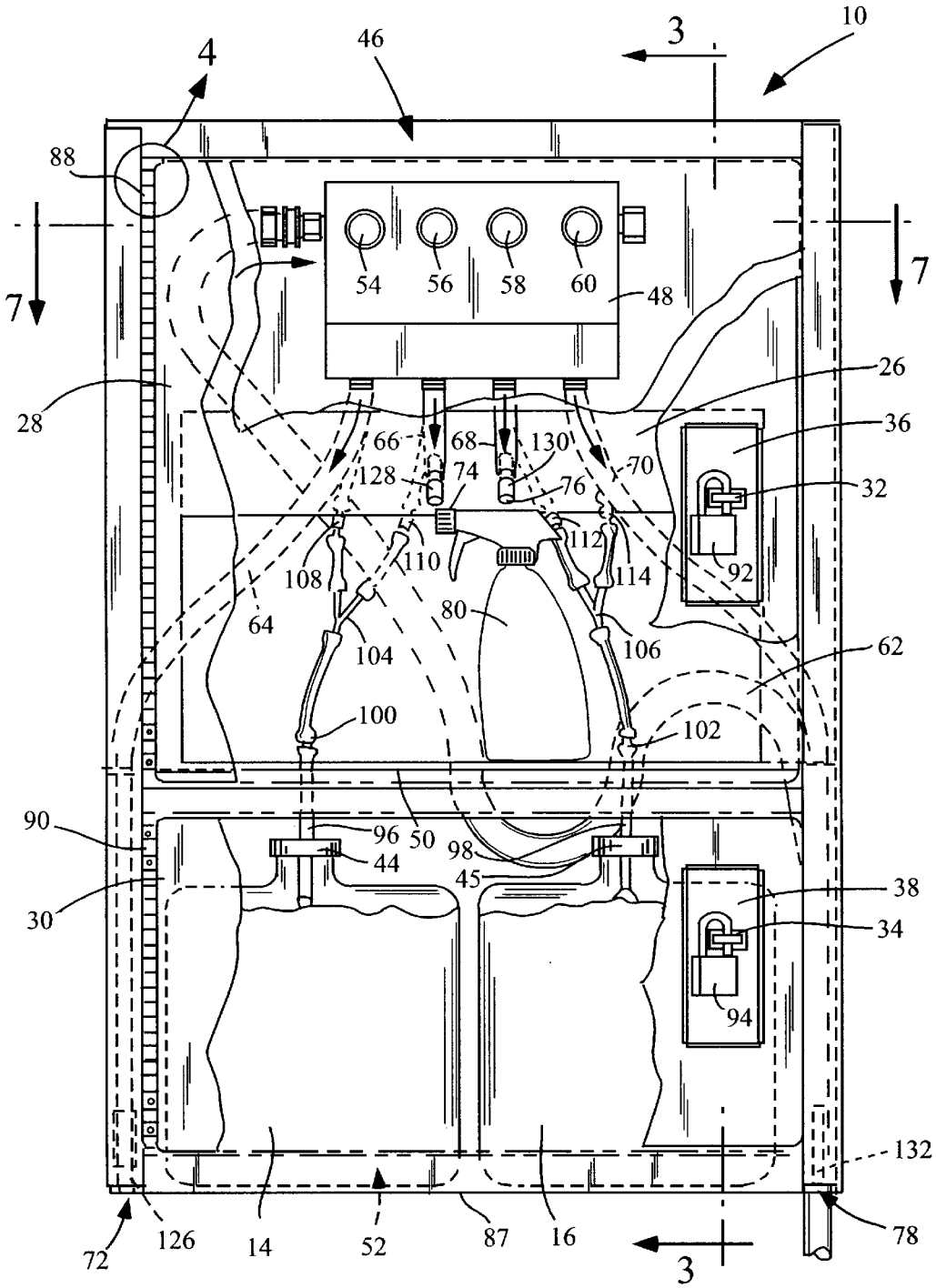
FIG. 2 is a front partial cross-sectional view of the dispensing unit of FIG. 1.

Referring next to FIG. 2, shown is a front partial cross-sectional view of the dispensing unit 10 of FIG. 1. Shown is the upper lockable door 28, the lower lockable door 30, the upper hinge 88, the lower hinge 90, the first concentrate supply reservoir 14, the second concentrate supply reservoir 16, a first lock 92, a second lock 94, the upper hasp 32, the lower hasp 34, a mixing unit 48, the water supply hose 62, a first concentrate supply tube 96, a second concentrate supply tube 98, a first barbed in-line connector 100, a second barbed in-line connector 102, a first Y connector 104, a second Y connector 106, a first check valve 108, a second check valve 110, a third check valve 112, a fourth check valve 114, the faceplate 26, the spray bottle or container 80, the first outlet 72, the second outlet 74, the third outlet 76, the fourth outlet 78, a first output hose 64, a second output hose 66, a third output hose 68, the fourth output hose 70, a first metal feed-through 126, the second metal feed-through 128, the third metal feed-through 130, the fourth metal feed-through 132, the first button 54, the second button 56, the third button 58, the fourth button 60, the first recessed cavity 36, the second recessed cavity 38, the first concentrate supply cap 44, the second concentrate supply cap 45, an upper chamber 46, the base 87, a lower chamber 52, and a horizontal plate 50.

The dispensing unit 10 features the upper lockable door 28 and the lower lockable door 30 that can be secured using the first lock 92 and the second lock 94, respectively, such as is known in the art, onto the upper hasp 32 and the lower hasp 34 within the first recessed cavity 36 in the upper locking door 28 or the second recessed cavity 38 in the lower locking door 30. Behind the lower lockable door 30, the first concentrate reservoir 14 and second concentrate reservoir 16 are accessible. Advantageously, the first lock 92 is less exposed to abuse or vandalism when in the first recessed cavity 36. The first recessed cavity 36 makes it harder to hit or exert pressure on the first lock 92, thus making the first lock 92 harder to break. The second lock 94 and the second recessed cavity 38 function in the same manner.

Preferably, the dispensing unit 10 has the first outlet 72, the second outlet 74, the third outlet 76, and the fourth outlet 78. The first outlet 72 and fourth outlet 78 are located at the base 87 of the dispensing unit 10. The second outlet 74 and third outlet 76 are preferably located at the faceplate 26. Thus, the first button 54, the second button 56, the third button 58 and the fourth button 60 are used to activate valves within the mixing unit 48. The first button 54, the second button 56, the third button 58 and the fourth button 60 are accessible through the faceplate 26. However, the dispensing unit 10 could operate with only one outlet located either in the faceplate 26 or the base 87 of the dispensing unit 10 or with more than two outlets located either in the faceplate 26 or the base 87 of the dispensing unit 10. Additional buttons could be added if more outlets were added to the faceplate 26 or the base 87 of the dispensing unit 10. Additionally, alternative outlets could be located at various places on the dispensing unit 10.

The mixing unit 48 is concealed behind the faceplate 26. The faceplate is in the upper chamber 46. The faceplate 26 is accessible through the upper lockable door 28 and prevents access to the mixing unit 48, hoses, tubes and other hardware within the dispensing unit 10. A horizontal plate 50 or barrier separates the upper chamber 46 of the dispensing unit 10 from the lower chamber 52 of the dispensing unit 10, thus preventing access to the mixing unit 48 and other hardware located in the upper chamber 46, via the lower chamber 52 or the lower locking door 30. The upper chamber 46 and lower chamber 52 could also be side by side or the upper chamber 46 could be below the lower chamber 52 without affecting the use of the dispensing unit 10.

Advantageously, the dispensing unit 10 is mounted on a wall in a permanent or semi-permanent fashion at a height barely sufficient to allow the placement of the mop bucket 82 beneath the dispensing unit 10. Clearance may be, for example, one-half inch between the top of the mop bucket 82 and the base 87 of the dispensing unit 10, thus allowing sufficient room for the mop bucket 82 to be rolled beneath the dispensing unit 10, but insufficient clearance for a taller and larger receptacle to be placed beneath the dispensing unit 10. This prevents, for example, an inmate from using an excessive amount of cleaning product by filling up a larger receptacle than required for the job, such as a large garbage can. Advantageously, this helps keep the cost of cleaning down and the amount of cleaning product used to a minimal amount.

Within the dispensing unit 10, water is mixed in the mixing unit 48 with concentrate from the first concentrate reservoir 14 or the second concentrate reservoir 16 at particular ratios, with the mixture being dispensed through one of the first outlet 72, the second outlet 74, the third outlet 76, and the fourth outlet 78, accessible at either an exterior of the dispensing unit 10 or through the faceplate 26 within the dispensing unit 10.

The first concentrate reservoir 14 and the second concentrate reservoir 16 are preferably a first flexible plastic bladder and a second flexible plastic bladder housed within a first cardboard container and a second cardboard container, respectively. The first flexible plastic bladder includes a first port through which the concentrate is withdrawn by suction into the first concentrate supply tube 96. The first port includes a first safety valve that prevents spillage of the concentrate from the first port, but opens when the first concentrate supply cap 44 is place onto the first port such as by screwing the first concentrate supply cap 44 onto the first concentrate reservoir 14 to permit the concentrate to exit through the first port. The first flexible plastic bladder collapses as the concentrate is drawn out of the first flexible plastic bladder through the first concentrate supply cap 44 and little or no air is allowed to enter the first concentrate supply tube 96 or the first flexible plastic bladder.

The concentrate is drawn through the first concentrate supply cap 44 and into the first concentrate supply tube 96, and then up into the upper chamber 46 of the dispensing unit 10 to the mixing unit 48. Once the concentrate reaches the mixing unit 48, it is mixed with a prescribed amount of water when a valve is opened in the mixing unit 48 in response to the pressing of the first button 54, accessible through the faceplate 26. When the first button 54 is pressed, pressure available on the water supply hose 62, e.g., city water pressure, forces a mixing of the concentrate with water at the prescribed ratio, through the Venturi effect. The Venturi effect is used to suction the concentrate from the first flexible plastic bladder through the first concentrate supply tube 96.

The mixed water and concentrate then leaves the mixing unit 48 through the first output hose 64 that routes the mixed water and concentrate to the first outlet 72 at the base 87 of the dispensing unit 10. Alternatively, if a second button 56 is pressed, pressure available on the water supply hose 62, e.g., city water pressure, forces a mixing of the concentrate with water at the prescribed ratio, through the Venturi effect. The Venturi effect is used to suction the concentrate from the first flexible plastic bladder through the first concentrate supply hose 96. The mixed water and concentrate then leaves the mixing unit 48 through the second output hose 66 that routes the mixed water and concentrate to the second outlet 74 located at the faceplate 26 of the dispensing unit 10.

The second outlet 74 and a third outlet 76 at the faceplate 26 are for filling small hand-held bottles or containers 80, such as spray bottles while the first outlet 72 and the fourth outlet 78 located at the base 87 of the dispensing unit 10 are for filling larger receptacles, such as mop buckets 82. Advantageously, at the second outlet 74, and the third outlet 76 the second metal feed-through 128 and the third metal feed through 130 are welded to the faceplate 26. The second output hose 66 and the third output hose 68 attach to the second metal feed-through 128 and the third metal feed-through 130 on the backside of the faceplate 26. The second output hose 66 and third output hose 68, thus are not exposed outside the faceplate 26 and thus can not be pulled on from outside. This helps prevent damage to the mixing unit 48 by not allowing the second output hose 66 or third output hose 68 to be pulled, thus putting pressure on the mixing unit 48.

Advantageously, in use, the lower lockable door 30 is generally left in a locked state. The buttons 54, 56, 58, 60 and the outlets 74, 76 are accessible when only the upper lockable door 28 is opened. Storage of the spray bottle or container 80 within the indentation in the faceplate 26 also advantageously provides a convenient and secure storage capability.

The upper lockable door 28 can be secured in a locked position when the dispensing unit 10 is not in use and opened when the dispensing unit 10 is in use, whereby mixed concentrate and water, a cleaning product, can be dispensed only when the upper lockable door 28 is opened. When the upper lockable door 28 is closed and locked, the buttons 54, 56, 58, 60 cannot be accessed, and thus no product can be dispensed through either the second outlet 74 and the third outlet 76 in the faceplate 26 or the first outlet 72 and fourth outlet 78 located in the base 87 of the dispensing unit 10.

The indentation in the faceplate 26 limits access to the second outlet 74 and the third outlet 76, located in the faceplate 26, thus preventing bottles or containers above a predefined height from being positioned within the indentation for filling at the second outlet 74 or the third outlet 76. This height restriction functions similarly to the height restriction imposed by placing the dispenser unit 10 so that very little clearance is afforded between the height of the mop bucket 82 and the base 87 of the dispensing unit 10.

Water under pressure is supplied to the dispensing unit 10 through the water supply hose 62, which passes up through the base 87 of the dispensing unit 10, then up and down through the horizontal plate 50 in a serpentine fashion so as to provide strain relief against pulling on the water supply hose 62 from beneath the dispensing unit 10. This is effective in preventing damage to the mixing unit 48 when the water supply hose 62 is pulled upon. Advantageously, a coupling 124, better shown in FIG. 3, between the water supply hose 62 and an internal portion of the water supply hose 62 is made in the lower chamber 52 of the dispensing unit 10 and is thus not accessible from outside the dispensing unit 10. After passing up through the horizontal plate 50 looping over and back down through the horizontal plate 50 and then looping back up through the horizontal plate 50, for a total of three passes through the horizontal plate 50, the upper portion of the water supply hose 62 is coupled to the mixing unit 48.

Within the mixing unit 48, the water under pressure supplied by the water supply hose 62 is routed to four valves that are actuated, respectively, by the first button 54, the second button 56, the third button 58, and the fourth button 60. Upon actuation of, for example, the first button 54, water is allowed to flow into a mixing chamber within the mixing unit 48 wherein concentrated cleaning product is drawn from the first cleaning reservoir 14 up through the first concentrate supply tube 96 and mixed with the water passing through the mixing chamber by the Venturi effect.

After mixing, the mixed water and concentrate pass out of the mixing unit 48 into the first output hose 64 which directs the mixed water and concentrate to the first outlet 72 at the base 87 of the dispensing unit 10. Advantageously, at the first outlet 72, the first output hose 64 is coupled to the first metal feed-through 126 that is welded to the base 87 of the dispensing unit 10, thereby making the first output hose 64 inaccessible from outside the dispensing unit 10.

Similarly, when the second button 56 is depressed, a second valve is opened allowing water to flow into a second mixing chamber. Concentrated cleaning product is drawn up from the first cleaning reservoir 14 into a second mixing chamber, and mixed with water from the water supply hose 62. The mixed water and concentrate is then directed to the second outlet 74 located in the faceplate 26. Again, advantageously, the second output hose 66 is coupled to the second metal feed-through 128, which is welded through the faceplate 26 so that the second output hose 66 cannot be accessed from outside of the dispensing unit 10, even when the upper lockable door 28 is open.

When the third button 58 is depressed, water from the water supply hose 62 enters a third mixing chamber and concentrated cleaning product is drawn from the second concentrate reservoir 16 up through the second concentrate supply tube 98 to the third mixing chamber. Water mixed with concentrate exits the third mixing chamber into the third output hose 68, which is directed to the third outlet 76 located in the faceplate 26. At the third outlet 76 the third metal feed-through 130 is welded to the faceplate 26. The third output hose 68 is coupled to the third metal feed-through 130 to prevent the third output hose 68 from being accessed even when the upper lockable door 28 is open.

When the fourth button 60 is depressed, similar operation occurs with water and concentrate from the second concentrate reservoir 16 being mixed in a fourth mixing chamber and mixed water and concentrate being directed through the fourth output hose 70 to the fourth outlet 78 on the base 87 of the dispensing unit 10. As with the other outlets, the fourth metal feed-through 132 is welded to the base 87 of the dispensing unit 10 so the fourth output hose 70 is not accessible from outside the dispensing unit 10.

Near a first concentrate supply tube hole 160 in the horizontal plate 50 through which the first concentrate supply tube 96 passes, the first concentrate supply tube 96 is cut, with the first barbed inline connector 100 being inserted to allow connection of a remainder of the first concentrate supply tube 96 to an initial portion. Advantageously, the first concentrate supply tube 96 is stretched over the first barbed inline connecter 100 to a diameter that exceeds a diameter of the first concentrate supply tube hole 160 in the horizontal plate 50. This prevents tension placed on a portion of the first concentrate supply tube 96 below the horizontal plate 50 from being translated to any portion of the concentrate supply tube above the first barbed inline connector 100. In other words, even if the portion of the first concentrate supply tube 96 protruding below the horizontal plate 50 were pulled so hard as to break it, no strain would be placed on the mixing unit 48 or the portions of the first concentrate supply tubes 96 above the horizontal plate 50. The same operation takes place with respect to the second concentrate supply tube 98, the second barbed inline connecter 102, and a second concentrate supply tube hole 162.

Above the first barbed inline connector 100, the first Y connector 104 is placed so as to allow concentrate from the first concentrate reservoir 14 to be supplied to the first and second mixing chambers. Above the first Y connector 104, the first check valve 108 and the second check valve 110 are inserted in each of the two concentrate supply tube segments above the first Y connectors 104. The first check valves 108 and the second check valve 110 prevent concentrate or air from leaking back down through the first concentrate supply tube 96. This functionality is advantageous when, for example, the first button 54 is depressed so that no air is drawn from the second mixing chamber into the first concentrate supply tube 96. The second check valve 110 would prevent the air from the second mixing chamber from going into the first concentrate supply tube 96. The other remaining check valves 108, 112, 114 function in a similar fashion when an adjacent mixing chamber is utilized.

Figure 3:
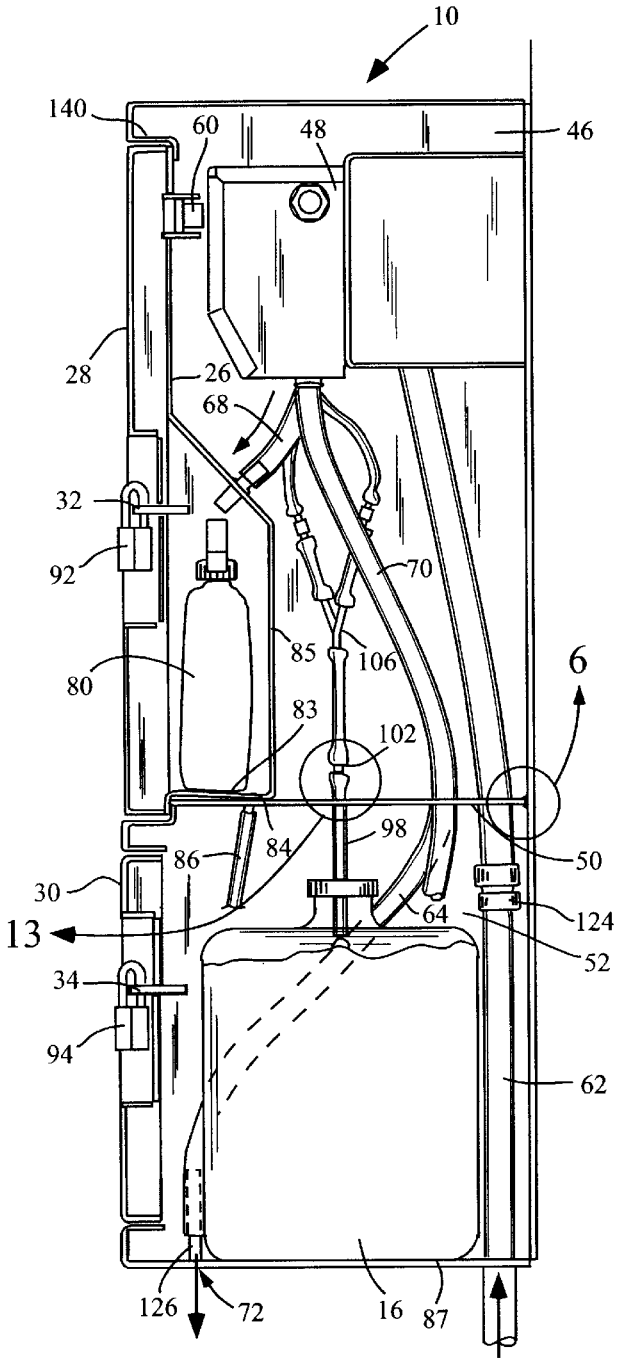
FIG. 3 is a side partial cross-sectional view of the dispensing unit of FIG. 1.

Referring next to FIG. 3, a side view is shown, partially in cross-section, of the dispensing unit 10. Shown is the upper padlock 92, the lower padlock 94, the upper hasp 32, the lower hasp 34, the upper lockable door 28, the lower lockable door 30, the horizontal plate 50, the second supply reservoir 16, the water supply hose 62, the coupling 124, the second concentrate supply tube 98, the second barbed in-line connector 102, the second Y connector 106, the first output hose 64, the third output hose 68, the fourth output hose 70, the first outlet 72, the first metal feed-through 126, the faceplate 26, the spray bottle or container 80, the drain hole 84, a lower surface 83 of the indentation 85 in the faceplate 26, a drain tube 86, the upper chamber 46, the lower chamber 52, the mixing unit 48, the fourth button 60, and the spray bottle or container 80.

The drain hole 84 is also preferably located at the lower surface 83 of an indentation 85 in the faceplate 26 so that any dripage or spillage resulting from the filling of bottles or containers 80 at the faceplate 26 is directed into the drain hole 84 and routed through the drain tube 86 to a drainage outlet 168 at the base 87 of the dispensing unit 10.

The drain tube 86 passes between the first concentrate reservoir 14 and the second concentrate reservoir 16 to the base 87 of the dispensing unit 10 where it is connected to the drainage outlet 168 welded to the base 87 of the dispensing unit 10. This prevents the drain tube 86 from being exposed outside the dispensing unit 10, thus preventing it from being pulled upon. Similarly, the drain tube 86 is connected to the drain hole 84 behind the faceplate 26 so as not to expose the drain tube 26 to the outside of the dispensing unit 10 even when the upper lockable door 28 is unlocked.

As can be seen, a lower surface 83 of the indentation 85 of the faceplate 26 is tipped slightly toward the rear of the dispensing unit 10 so that any spillage falling on the lower surface 83 is directed to the drain hole 84 and through the drain tube 86 to the outlet at the base 87 of the dispensing unit 10.

As can be seen, the coupling 124 between the water supply hose 62 and an upper portion of the water supply hose 62 is within the lower chamber 52 of the dispensing unit 10 and thus not accessible from outside the dispensing unit 10. The portion of the water supply hose 62 is coupled to the mixing unit 48, where, as explained above, cleaning product from the concentrate supply tubes are mixed with water from the water supply hose 62 and directed out through the first output hose 64, the second output hose 66, the third output hose 68 and the fourth output hose 70 through the first outlet 72, the second outlet 74, the third outlet 76, and the fourth outlet 78, respectively. The first outlet 72, the second outlet 74, the third outlet 76, and the fourth outlet 78 are coupled to a first metal feed-through 126, a second metal feed-through 128, a third metal feed-through 130, and a fourth metal feed-through 132, respectively, welded through the faceplate 26 or base 87 of the dispensing unit 10. The first metal feed-through 126 and fourth metal feed-through 132 are welded to the base 87 of the dispensing unit 10. The second metal feed-through 128 and third metal feed-through 130 are welded to the faceplate 26.

Advantageously, the first metal feed-through 126, the second metal feed-through 128, the third metal feed-through 130, and the fourth metal feed-through 132 prevent the first output hose 64, the second output hose 66, the third output hose 68 and the fourth output hose 70, respectively, from being exposed outside the base 87 of the dispensing unit 10 or the outside of the faceplate 26. This prevents, for example, an inmate or vandal from pulling on one of the output hoses and damaging the output hoses or mixing unit 48.

Figure 4:
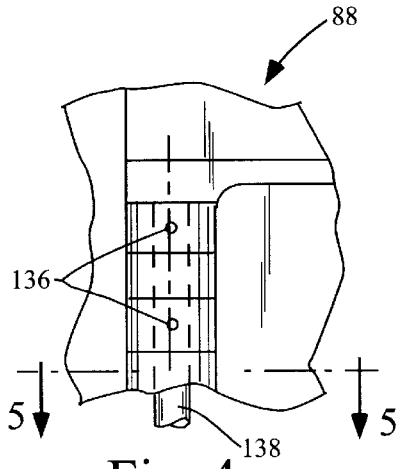
FIG. 4 is an enlarged view of the end of the upper hinge in FIG. 1 with crimps in the hinge to secure a hinge pin into the hinge.

Referring next to FIG. 4, an end of the upper hinge 88 is shown with crimps 136 in the upper hinge 88 to secure a hinge pin 138 into the upper hinge 88. The upper hinge 88 is crimped only on alternative sections so as to allow the door to open while not allowing the hinge pin 138 to slide out of the upper hinge 88. Advantageously, this does not allow an inmate in a jail or prison to remove the hinge pin 138 and furnish it into a weapon.

Figure 5:
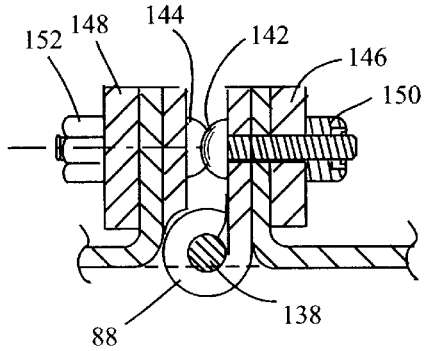
FIG. 5 is a top view of the hinge in FIG. 1 the hinge being recessed behind the top of the dispensing unit.

Referring to FIG. 5, a top view is shown of the upper hinge 88, with the upper hinge 88 being recessed, so that the hinge pin 138 will not clear a frame of the upper lockable door 28, and thus cannot be removed from the upper hinge 88, even if the crimps in the upper hinge 88 are loosened. The top portion 140, shown in FIG. 3, of the dispensing unit 10 will always be on top of the hinge pin 138, whether the upper lockable door 28 is open or closed, thus preventing the hinge pin 138 from sliding out of the upper hinge 88. The hinge pin 138 may also be optionally welded to the upper hinge 88 at its ends, to further make difficult its removal.

The upper hinge 88 is secured to the upper lockable door 28 using prison screws 142, 144, or other difficult to remove fasteners, that pass through the upper hinge 88 and through a steel plate 146, 148 to lock nuts 150, 152, i.e., hex nuts including nylon inserts. Advantageously, the steel plates 146, 148 are juxtaposed along the height of respective halves of the upper hinge 88, and are threaded, such than even in the event the lock nuts 150, 152 are removed, the prison screws 142, 144 are not readily removable from the upper hinge 88. Both sides of the upper hinge 88 are secured, respectively, to the door frame or upper lockable door 28 using prison screws 142, 144, steel plates 146, 148, and lock nuts 150, 152. The lower lockable door 30 and the lower hinge 90 function in a similar manner.

Figure 6:
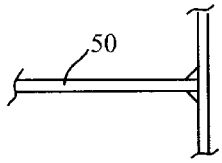
FIG. 6 is a side view of a horizontal plate from FIG. 3 welded to the back of the dispensing unit.

Referring to FIG. 6, the horizontal plate 50 is shown welded to a back of the dispensing unit 10. The horizontal plate 50 advantageously separates the lower chamber 52 of the dispensing unit 10 from the upper chamber 46 of the dispensing unit 10. This helps to isolate different areas of the dispensing unit 10 and helps to prevent damage to the mixing unit 48. Additionally, it isolates the concentrate supply reservoirs 14, 16 from the buttons 54, 56, 58, 60 of the dispensing unit 10. This allows the dispensing unit 10 to operate, while only allowing access to the upper chamber 46 of the dispensing unit 10.

Figure 7:
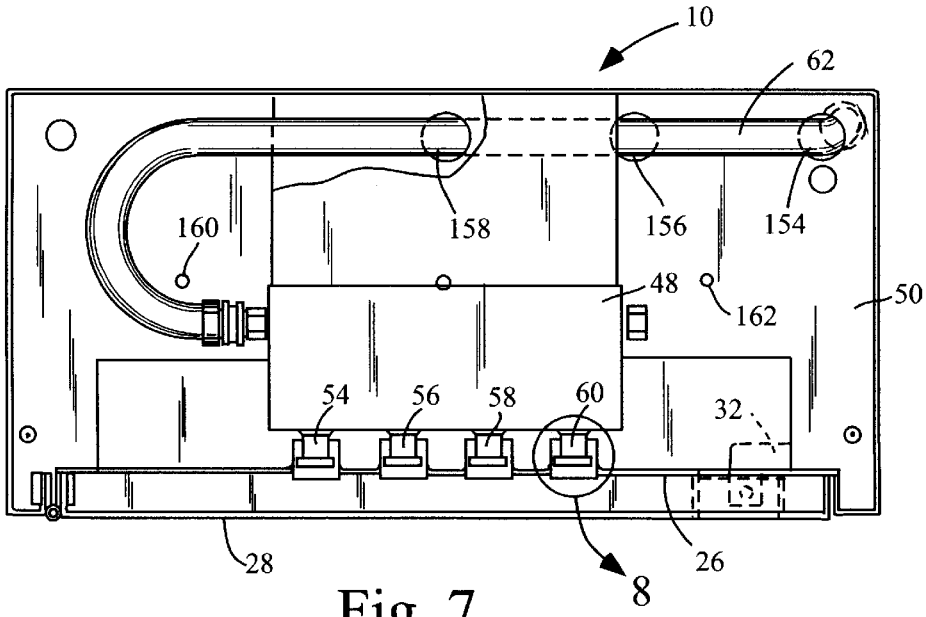
FIG. 7 is a top partial cross-sectional view of the dispensing unit of FIG. 1.

Advantageously, the horizontal plate 50 also helps to protect the mixing unit 48. The horizontal plate 50 does not allow any pressure to be put on the mixing unit 48 when someone pulls on either the water supply hose 62 or one of the first concentrate supply tube 96 and second concentrate supply tube 98. The three holes 153, 155, 157 for the water supply hose 62, shown in FIG. 7, provide a strain relief such that if someone pulls on the water supply hose 62 from outside the dispensing unit 10 the horizontal plate 50 will not allow the water supply hose 62 to pull on the mixing unit 48. Additionally, if someone while accessing the lower chamber 52 were to pull on the first concentrate supply tube 96 or the second concentrate supply tube 98, a first concentrate supply hose hole 160 and a second concentrate supply hose hole 162 in the horizontal plate 50 acting in combination with the first barbed in-line connector 100 and the second barbed in-line connector 102, respectively, would prevent the concentrate supply tubes from pulling on the mixing unit 48. This is further shown in FIG. 13.

Referring to FIG. 7, a top view is shown of the dispenser unit 10, partially in cross section. Shown are the water supply house 62, the mixing unit 48, the first button 54, the second button 56, the third button 58, the fourth button 60, the horizontal plate 50, the faceplate 26, the upper lockable door 28, the upper hasp 32, a first water supply hose hole 154, a second water supply hose hole 156, a third water supply hose hole 158, the first concentrate supply tube hole 160, and the second concentrate supply tube hole 162.

The water supply hose holes 154, 156, 158 help to prevent damage to the mixing unit 48. The water supply hose 62 first comes up through the first water supply hose hole 154 into the upper chamber 46, then down through the second water supply hose hole 156 into the lower chamber 52, and finally back up through the third water supply hose hole 158 into the upper chamber 46 before it attaches to the mixing unit 48. This is one design that provides protection to the mixing unit 48 by providing strain relief on the water supply hose 62 should it be pulled upon from the outside of the dispensing unit 10. More holes or other means of providing strain relief could also be utilized.

Additionally, the concentrate supply tube holes 160, 162 prevent damage to the mixing unit 48 in the event the concentrate supply tubes 96, 98 are pulled upon. This is further shown in FIG. 13.

Figure 8:
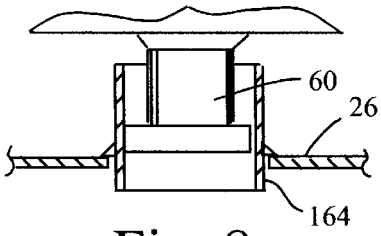
FIG. 8 is a enlarged cross sectional view of a button shown in FIG. 7.

Referring to FIG. 8, a partial cross sectional view is shown of a button, such as the fourth button 60. Also shown is a metal cylinder 164, and a portion of the faceplate 26. The metal cylinder 164 prevents access to behind the faceplate 26, and hinders the use of prying tools on the fourth button 60, such as may be used to remove the fourth button 60. Additionally, the metal cylinder 164 helps prevent objects from being lodged between the fourth button 60 and the metal cylinder 164, thus locking the fourth button 60 into a depressed position. The metal cylinder 164 advantageously helps to prevent damage to the fourth button 60 and prevents the fourth button 60 from being pulled. This is achieved by having a negligible amount of space between the exterior edges of the fourth button 60 and the interior of the metal cylinder 164. Additionally, the fourth button 60 does not extend beyond the faceplate 26 or the metal cylinder 164, which helps to prevent the fourth button 60 from being inadvertently pushed or damaged by anything bumping into or hitting the dispensing unit 10. The first button 54, the second button 56, and the third button 58 function in the same manner.

Figure 9:
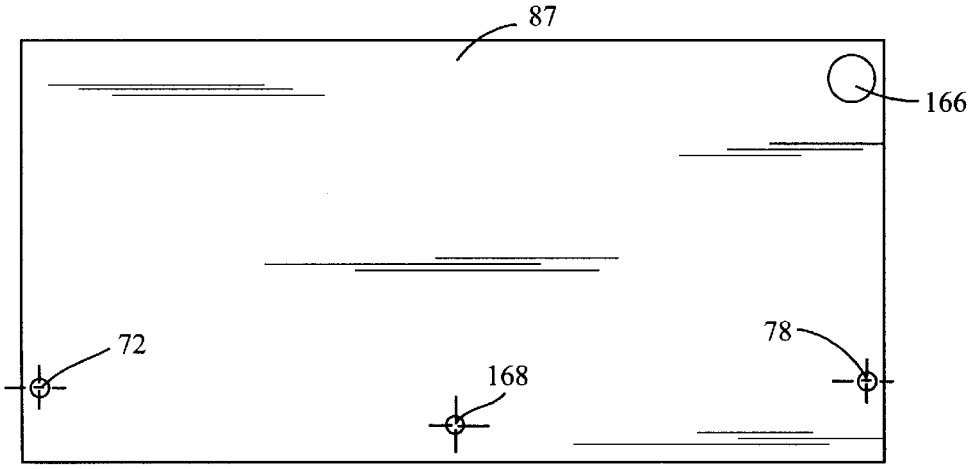
FIG. 9 is a top view is shown of a base of the dispensing unit of FIG. 1.

Referring to FIG. 9, a top view is shown of the base 87 of the dispensing unit 10. Shown is a water supply hose hole 166, the first outlet 72, the fourth outlet 78, and the drainage outlet 168. Advantageously, the first outlet 72, the fourth outlet 78 and the drainage outlet 168 have the first metal feed-through 126, the fourth metal feed-through 132, and a drainage metal feed-through, respectively, on the inside of the lower chamber 52 such that any tubing does not extend to the outside of the dispensing unit 10. Although not shown, a similar feed-through could be used for the water supply hose 62 on the inside of the lower chamber 52. If a metal feed through was used for the water supply hose 62, the water supply hose 62 would not have to wind up and down through the horizontal plate 50, as the mixing unit 48 would already be protected from pulling on the water supply hose 62.

Figure 10:
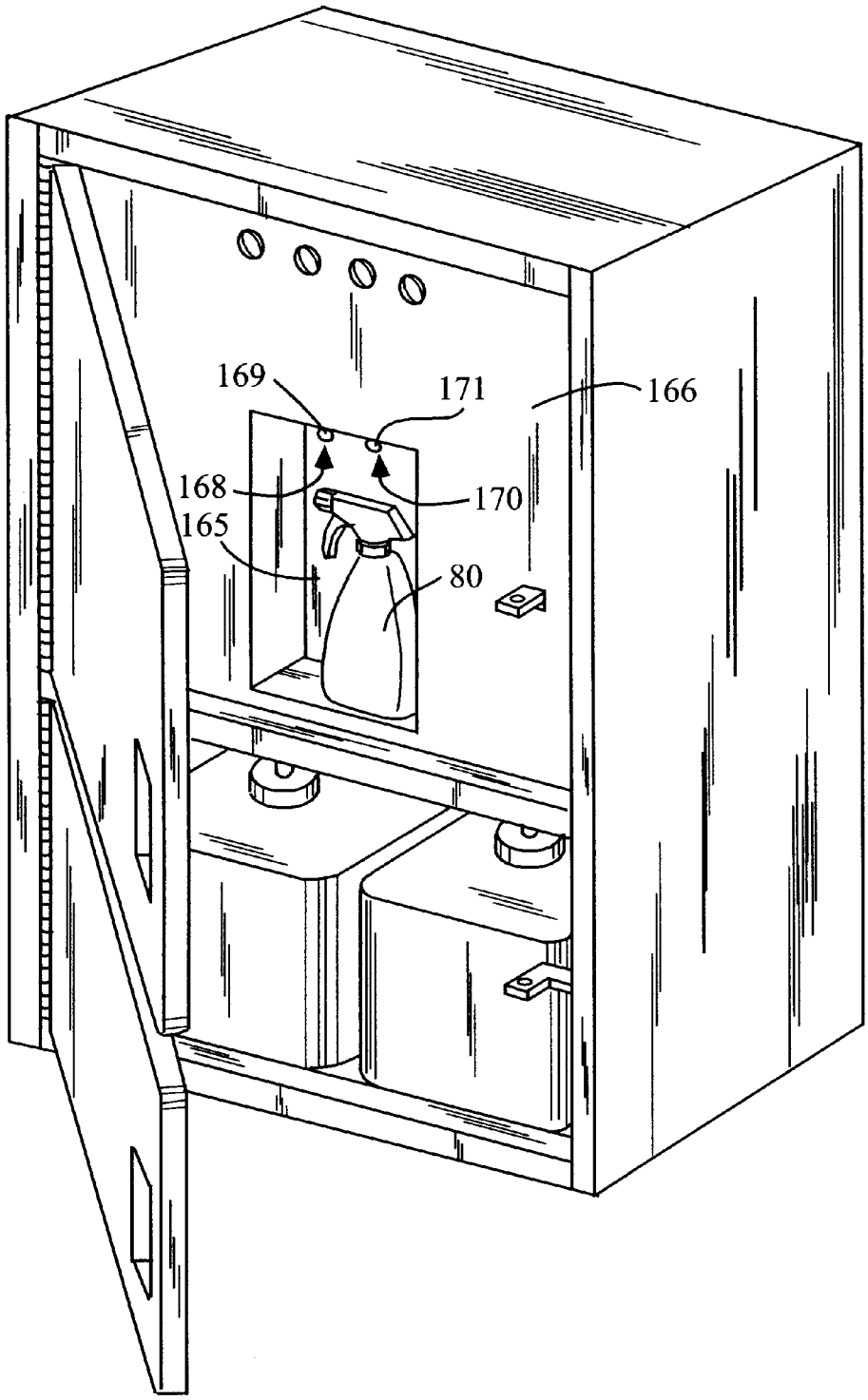
FIG. 10 is the dispenser unit for use with soap and other cleaning or chemical materials with an alternative faceplate.

Referring to FIG. 10, a perspective view is shown of an alternative embodiment of the dispensing unit 10 of FIG. 1. The alternative dispensing unit 10 is similar to the dispensing unit 10 of FIG. 1 in all respects, except in the design of the indentation 165 in a faceplate 166, and position and orientation of a first output 168 and a second output 170 in the faceplate 166, and the direction of a first metal feed-through 169 and a second metal feed-through 171.

Advantageously, the first output 168 and second output 170 are on a top portion of the indentation 165 of the faceplate 166. The first metal feed-through 169 and second metal feed-through 171 are welded to the faceplate 166 at the first output 168 and second output 170, respectively, The second output hose 66 and third output hose 68 are connected to the first metal feed-through 169 and second metal feed-through 171, respectively, behind the faceplate 166 so as not to expose any tubing outside the dispensing unit 10. The first metal feed-through 169 and second metal feed-through 171 are advantageously directed toward the back of the faceplate 166 as can be seen in FIG. 12.

As can be seen, the indentation 165 is smaller than the indentation 85 shown in FIG. 1, limited in size to dimensions just big enough to accommodate the spray bottle or container 80 shown. In this way the filling of larger containers is inhibited.

Figure 12:
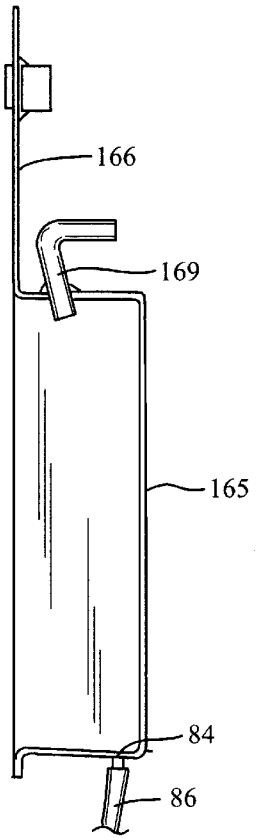
FIG. 12 is a side partial cross-section of the faceplate of FIG. 10.
Figure 11:
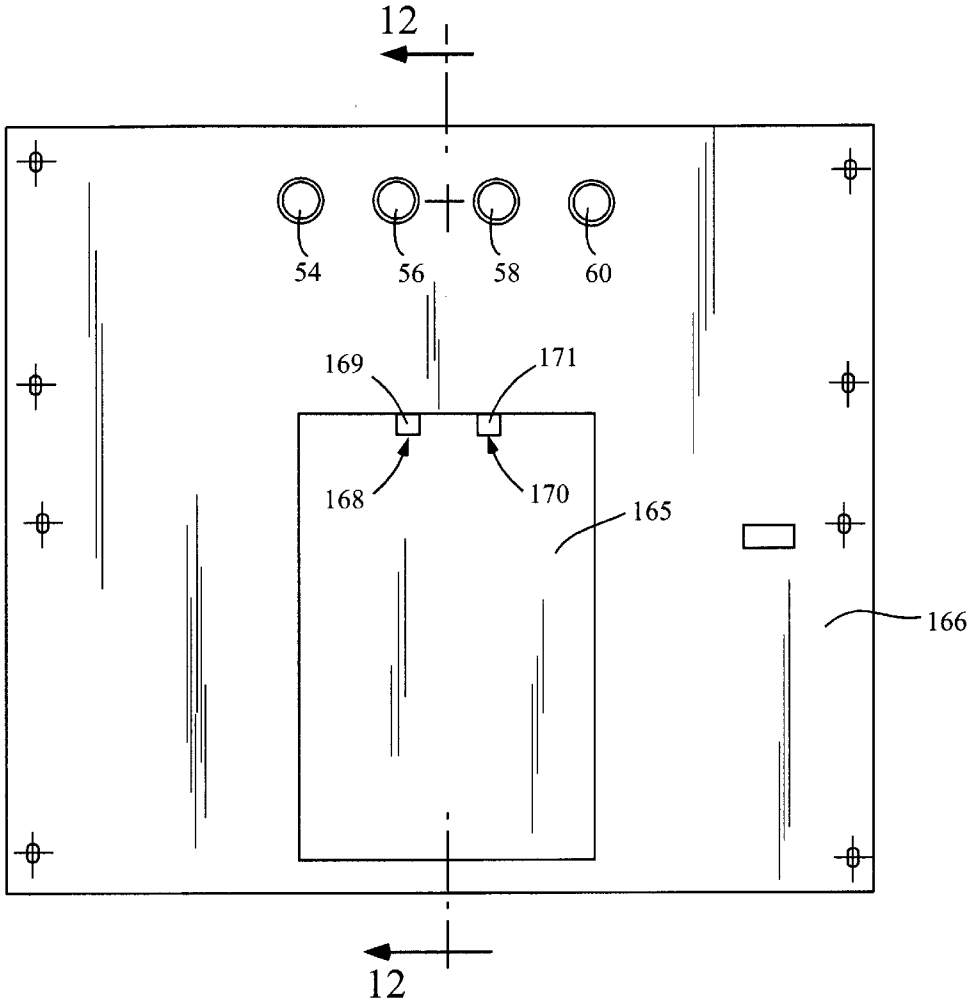
FIG. 11 is a front cross-section view of the faceplate of FIG. 10.

FIG. 11 is a front view of the faceplate 166 of the alternative design, and FIG. 12 is a side view of the faceplate 166 of the alternative design. As can be seen, the first metal feed-through 169 and second metal feed-through 171 welded through the faceplate 166 are bent and angled slightly back toward a back of the indentation 165 in the faceplate 166. This orientation prevents or makes difficult the filling of receptacles unless they are inserted into the indentation. This prevents large containers from being filled as the cleaning solution of water and concentrate will not be dispensed outwardly from the dispensing unit 10, but rather slightly toward the back of the faceplate 166 where a large container will not fit. Also shown in FIG. 12 is the drain hole 84, and the drain tube 86, as well as one of the metal cylinders that envelop the buttons 54, 56, 58, 60, such as better shown in FIG. 8.

Advantageously, the drain hole 84 is a metal tube and the drain tube 86 connects to the metal tube behind the faceplate 166. Again this prevents access to the drain tube 86 and prevents the drain tube 86 from being pulled on or ripped out of the dispensing unit 10. The bottom section of the faceplate 166 containing the drain hole 84 is slightly angled such that any excess fluid coming from the first output 168 and the second output 170 will be directed back to the drain hole 84 and not spill over the front of the dispensing unit 10.

Figure 13:
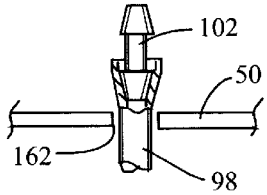
FIG. 13 is a enlarged view of a barbed in-line connector shown in FIG. 3.

Referring to FIG. 13, shown is the concentrate supply tube hole 162 shown in FIG. 7 and the second barbed in-line connector 102 and the second concentrate supply tube 98 shown in FIGS. 2 and 3.

The second barbed in-line connector 102 is inserted into the second concentrate supply tube 98 in the upper chamber 46 of the dispensing unit 10. The diameter of the second barbed in-line connector 102 is greater than the diameter of the second concentrate supply tube hole 162 in the horizontal plate 50. Advantageously, when the second concentrate supply tube 98 is pulled on from the lower chamber 52 the second barbed in-line connector 102 will be pulled down toward the second concentrate supply tube hole 162, but not allow the second concentrate supply tube 98 to be pulled any further. This prevents any pressure from being put on the mixing unit 48, as the second concentrate supply tube 98 will break in the lower chamber 52 without any pressure being put on the mixing unit 48 because the second barbed in-line connector 102 will not go through the second concentrate supply tube hole 162. This helps prevent damage to the second concentrate supply tube 98 and mixing unit 48 in the upper chamber 46. The first barbed in-line connector 100, first concentrate supply tube 96, and first concentrate supply tube hole 160 function in the same manner as describe above.

Additionally, the same functionality could be used for the first output hose 64 and the fourth output hose 70. For example, a barbed in-line connector could be inserted in the first output hose 64 just above the horizontal plate 50. Advantageously, if the first output hose 64 were pulled, no pressure would be put on the mixing unit 48 because the barbed in-line connector would not go through the hole in the horizontal plate 50. This would also prevent damage to the portion of the, first output hose 64 which is in the upper chamber 46. Advantageously, this prevents damage to the mixing unit 48 even when the lower lockable door 30 is open.

Figure 14:
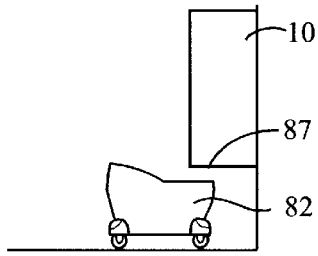
FIG. 14 is a side view of the dispensing unit of FIG. 1 mounted on a wall with a mop bucket underneath the dispensing unit.

Referring to FIG. 14, a side view is shown of the dispensing unit attached to a wall. Shown is the dispensing unit 10, the wall, and the mop bucket 82.

Advantageously, when the mop bucket 82 is below one of the first outlet 72 and the fourth outlet 78 at the base 87 of the dispensing unit 10 there is a small clearance between the top of the mop bucket 82 and base 87 of the dispensing unit 10. For example, the distance could be one half of an inch. However, any distance which prevents taller and larger receptacles which are not meant to be filled with the liquid, and are available, from fitting below the dispensing unit 10, would be sufficient. This reduces the amount of wasted fluid and thus decreases the cost of cleaning.

While the invention herein disclosed has been described by means of specific embodiments and applications thereof, numerous modifications and variations could be made thereto by those skilled in the art without departing from the scope of the invention set forth in the claims.

I claim:

1. An apparatus for dispensing liquid comprising:
an enclosed chamber;
a mixing unit within the enclosed chamber;
a first supply hose coupled to the mixing unit;
a second supply hose coupled to the mixing unit;
an output hose coupled to the mixing unit;
a feed-through coupled to the output hose;
a protective plate covering the mixing unit; and
the feed-through for dispensing the liquid being in the protective plate.

2. The apparatus of claim 1 further comprising a cavity in the protective plate whereby at least one dimension of a container is limited to a maximum by the shape of the cavity.

3. The apparatus of claim 2 wherein the feedthrough is angled toward the back of the cavity.

4. The apparatus of claim 3 wherein the feedthrough is stiff and incapable of being aimed in any direction other than angled toward the back of the cavity.

5. The apparatus of claim 1 wherein the protective plate is coupled to the enclosed chamber.

6. The apparatus of claim 1 further comprising at least one pushbutton in the protective plate.

7. The apparatus of claim 6 further comprising:
a lockable hinged cover for selectively covering the pushbutton;
wherein the pushbutton is not accessible when the cover is closed; and
wherein the pushbutton is accessible when the cover is open.

8. The apparatus of claim 1 further comprising a drain hole in the protective plate.

9. The apparatus of claim 1 further comprising:
the supply hose for transporting a liquid from a supply reservoir to the mixing unit;
wherein the protective plate prevents the supply hose from being accessed.

10. An apparatus for dispensing liquid comprising:
an enclosed chamber;
a mixing unit within the enclosed chamber;
a first supply hose coupled to the mixing unit;
a second supply hose coupled to the mixing unit;
an output hose coupled to the mixing unit;
a feed-through coupled to the output hose; and
a cavity in the protective plate whereby at least one dimension of a container is limited to a maximum by the shape of the cavity.

11. The apparatus of claim 10 wherein the feed-through is angled toward the back of the cavity.

12. The apparatus of claim 11 wherein the feed-through is stiff and incapable of being aimed in any direction other than angled toward the back of the cavity.

13. An apparatus for dispensing liquid comprising:
an enclosed chamber;
a mixing unit within the enclosed chamber;
a first supply hose coupled to the mixing unit;
a second supply hose coupled to the mixing unit;
an output hose coupled to the mixing unit;
a feed-through coupled to the output hose; and
a pusbutton for drawing liquid into the mixing unit.

14. The apparatus of claim 13 further comprising:
a cylindrical sleeve wherein the pushbutton resides;
whereby the pushbutton can only be accessed from a frontal direction.

15. The apparatus of claim 13 further comprising:
a lockble hinged cover for selectively covering the pushbutton;
wherein the pushbutton is not accessible when the cover is closed; and
wherein the pushbutton is accessible when the cover is open.

16. The apparatus of claim 1 further comprising:
the output hose coupled to the mixing unit and the feed-through;
wherein the output hose supplies a mixed liquid from the mixing unit to the feed-through;
wherein the output hose is not exposed outside the enclosed chamber.

17. An apparatus for dispensing liquid comprising:
an enclosed chamber;
a mixing unit within the enclosed chamber;
a first supply hose coupled to the mixing unit;
a second supply hose coupled to the mixing unit;

an output hose coupled to the mixing unit;

a feed-through coupled to the output hose;

a second output hose coupled to the mixing unit; and a second feed-through;

wherein the second output hose supplies a mixed liquid from the mixing unit to the second feed-through;

wherein the second output hose is not exposed outside the enclosed chamber.

18. An apparatus for dispensing liquid comprising:

an enclosed chamber;

a mixing unit within the enclosed chamber;

a first supply hose coupled to the mixing unit;

a second supply hose coupled to the mixing unit;

an output hose coupled to the mixing unit;

a feed-through coupled to the output hose;

a Y connector coupled to the first supply hose;

a first check valve coupled to the Y connector; and a second check valve coupled to the Y connector.

19. An apparatus for dispensing liquid comprising:

an enclosed chamber;

a mixing unit within the enclosed chamber;

a first supply hose coupled to the mixing unit;

a second supply hose coupled to the mixing unit;

an output hose coupled to the mixing unit;

a feed-through coupled to the output hose;

a strain relief coupled to the first supply hose for relieving strain between the first supply hose and the mixing unit; and a strain relief coupled to the second supply hose for relieving strain between the second supply hose and the mixing unit.

20. The apparatus of claim 1 wherein the liquid dispensing apparatus is mounted against a vertical surface at a height whereby at least one dimension of a bucket is limited to a maximum.

21. An apparatus for dispensing liquid comprising:

an enclosed chamber;

a mixing unit within the enclosed chamber;

a first supply hose coupled to the mixing unit;

a second supply hose coupled to the mixing unit;

an output hose coupled to the mixing unit;

a feed-through coupled to the output hose;

a hinge coupled to the enclosed chamber;

a hinge pin; and a crimp in the hinge;

wherein the hinge engages the hinge pin at the crimp, such that the hinge pin is not removable.

22. The apparatus of claim 21 wherein the hinge pin is welded to the hinge such that the hinge pin is not removable.

23. The apparatus of claim 21 wherein the hinge is recessed within the enclosed chamber.

24. An apparatus for dispensing liquid comprising:

an enclosed chamber;

a mixing unit within the enclosed chamber;

a first supply hose coupled to the mixing unit;

a second supply hose coupled to the mixing unit;

an output hose coupled to the mixing unit;

a feed-through coupled to the output hose;

a hinge coupled to the enclosed chamber; and a hinge pin;

wherein the hinge is recessed within the enclosed chamber.

25. The apparatus of claim 24 wherein the hinge pin is welded to the hinge such that the hinge pin it not removable.

26. The apparatus of claim 24 further comprising:

a crimp in the hinge;

wherein the hinge engages the hinge pin at the crimp, such that the hinge pin is not removable.

27. An apparatus for dispensing liquid comprising:

an enclosed chamber;

a mixing unit within the enclosed chamber;

a first supply hose coupled to the mixing unit;

a second supply hose coupled to the mixing unit;

an output hose coupled to the mixing unit;

a feed-through coupled to the output hose;

a hinge coupled to the enclosed chamber;

a hinge pin; and wherein the hinge pin is welded to the hinge such that the hinge pin is not removable.

28. The apparatus of claim 27 further comprising:

a crimp in the hinge;

wherein the hinge engages the hinge pin at the crimp, such that the hinge pin is not removable.

29. The apparatus of claim 27 wherein the hinge is recessed within the enclosed chamber.

30. An apparatus comprising:

a first compartment;

a second compartment coupled to the first compartment;

a first lockable door providing access to the first compartment;

a second lockable door providing access to the second compartment;

a mixing unit within the first compartment;

a supply hose for supplying the mixing unit with a liquid;

a protective plate concealing at least a portion of the supply hose when the first lockable door is open; and an output hose coupled to the mixing unit.

31. The apparatus of claim 30 further comprising:

a water supply hose coupled to the mixing unit; and a plate separating the first compartment from the second compartment.

32. The apparatus of claim 31 further comprising a liquid container coupled to the supply hose.

33. The apparatus of claim 30 further comprising a feed-through coupled to the output hose.

34. The apparatus of claim 30 further comprising:

a first recessed cavity in the first lockable door;

a second recessed cavity in the second lockable door;

a first hasp positioned to fit through a slot in the first lockable door when the first lockable door is closed; and a second hasp positioned to fit through a slot in the second lockable door when the second lockable door is closed.

35. The apparatus of claim 34 further comprising:

a first lock within the first recessed cavity; and a second lock within the second recessed cavity.

36. The apparatus of claim 30 wherein there is no access to the mixing unit when the first lockable door is closed.

37. The apparatus of claim 30 further comprising a protective plate concealing at least a portion of the supply hose when the first lockable door is open.

38. The apparatus of claim 37 further comprising:

a hole in the protective sheet; and a feed-through in the hole in the protective sheet.

39. The apparatus of claim 38 wherein the output hose is coupled to the feed-through.

40. The apparatus of claim 30 further comprising a plate separating the first compartment from the second compartment.

41. An apparatus comprising:

a cabinet comprising a first section and a second section;

a liquid container in the first section;

a mixing unit in the second section;

a supply hose coupled to the liquid container and to the mixing unit;

a plurality of output hoses coupled to the mixing unit;

a protective plate for concealing at least a portion of one of the plurality of supply hoses;

a plurality of holes in the protective plate; and a plurality of fee-throughs in the holes in the protective plate.

42. The apparatus of claim 41 further comprising a first lockable door coupled to the cabinet; and a second lockable door coupled to the cabinet.

43. The apparatus of claim 42 wherein the first lockable door prevents access to the first section of the cabinet;

wherein the second lockable door prevents access to the second section of the cabinet.

44. The apparatus of claim 42 further comprising:

a first lock for locking the first lockable door; and a second lock for locking the second lockable door.

45. The apparatus of claim 42 further comprising:

a cavity in the first lockable door; and a cavity in the second lockable door.

46. The apparatus of claim 45 further comprising:

a first hasp positioned to fit through a slot in the first lockable door when the first lockable door is closed;

a second hasp positioned to fit through a slot in the second lockable door when the second lockable door is closed;

a first lock in the cavity of the first lockable door; and a second lock in the cavity of the second lockable door.

47. The apparatus of claim 41 further comprising:

a plurality of supply hoses coupled to a plurality of liquid containers and to the mixing unit; and a water supply hose coupled to the mixing unit.

48. The apparatus of claim 41 wherein the protective plate conceals at least a portion of the plurality of output hoses.

49. The apparatus of claim 41 wherein the plurality of output hoses are coupled to the plurality of feed-throughs such that the plurality of output hoses are concealed behind the protective plate.

50. An apparatus for dispensing a liquid comprising:

a lockable container;

a separator within the lockable container separating the lockable container into a upper section and a lower section;

a supply hose within the lockable container;

a shield for protecting at least a portion of the supply hose; and an output hose for dispensing the liquid.

51. The apparatus of claim 50 further comprising:

a first door coupled to the lockable container; and a second door coupled to the lockable container.

52. The apparatus of claim 51 further comprising:

a first cavity in the first door; and a second cavity in the second door.

53. The apparatus of claim 52 further comprising:

a first hole in the first cavity;

a second hole in the second cavity;

a first hasp coupled to the lockable container; and a second has coupled to the lockable container;

wherein the first hasp fits partially through the first hole when the first door is closed;

wherein the second hasp fits partially through the second hole then the second door is closed.

54. The apparatus of claim 53 further comprising:

a first lock located in the first cavity; and a second lock located in the second cavity.

55. The apparatus of claim 50 further comprising a water supply hose coupled to a mixing unit.

56. The apparatus of claim 50 further comprising a supply reservoir coupled to the supply hose.

57. The apparatus of claim 56 wherein the supply reservoir is located in the lower section.

58. The apparatus of claim 50 further comprising a mixing unit coupled to the supply hose and the output hose.

59. The apparatus of claim 50 wherein the shield is located in the upper section.

60. The apparatus of claim 50 wherein the shield comprises a metal.

61. The apparatus of claim 50 further comprising a feed-through in the shield wherein the output hose is coupled to the feed through.

62. The apparatus of claim 61 wherein shield prevents access to the output hose.

63. The apparatus of claim 50 further comprising a feed-through in a bottom of the lockable container wherein the output hose is coupled to the feed-through.

64. A liquid dispensing apparatus comprising:

a chamber;

a supply hose within the chamber;

an output hose at least partially within the chamber;

a first lockable door coupled to the chamber; and a protective plate behind the lockable door for concealing at least a portion of the output hose when the lockable door is open.

65. The apparatus of claim 64 further comprising a second lockable door wherein a hinge pin of the second lockable door is blocked from being removed by a portion of the chamber;

wherein a hinge pin of the first lockable door is blocked from being removed by a portion of the chamber.

66. The apparatus of claim 65 wherein the hinge pin of the first lockable door is crimped;

wherein the hinge pin of the second lockable door is crimped.

67. The apparatus of claim 65 wherein the hinge pin of the first lockable door is recessed in the chamber such that it is blocked from being removed;

wherein the hinge pin of the second lockable door is recessed in the chamber such that it is blocked from being removed.

68. The apparatus of claim 65 wherein the chamber comprises;

a first compartment containing a mixing unit; and a second compartment containing a supply reservoir;

wherein the supply hose is coupled to the supply reservoir.

69. The apparatus of claim 68 wherein the protective plate is in the first compartment; wherein the protective plate has an output hole.

70. The apparatus of claim 69 further comprising a metal cylinder coupled to the output hole.

71. The apparatus of claim 69 wherein the output hose is coupled to the metal cylinder.

72. An apparatus comprising:

a cabinet;

a faceplate coupled to the cabinet;

a hole in the faceplate exposing an activation means;

an outlet in the faceplate for outputting a liquid through the faceplate; and a supply hose for supplying a liquid from a supply reservoir.

73. The apparatus of claim 72 further comprising:

a water supply hose coupled to a mixing unit; and an output hose coupled to the mixing unit and the outlet in the faceplate.

74. The apparatus of claim 72 further comprising a lockable plate such that when the lockable plate is closed the hole in the faceplate is covered.

75. The apparatus of claim 72 further comprising a plate within the cabinet;

wherein the plate has a plurality of holes;

wherein the water supply hose goes through the plurality of holes;

wherein the plate provides strain relief for the water supply hose.

76. The apparatus of claim 72 wherein at least a portion of the supply hose is behind the faceplate.

77. The apparatus of claim 72 further comprising:

a metal feed through in the faceplate; and a output hose coupled to the mixing unit and the metal feed through such that the output hose is behind the faceplate.

78. The apparatus of claim 72 further comprising a recessed portion in the faceplate wherein the hole is in the recessed portion of the faceplate.

* * * * *

UNITED STATES PATENT AND TRADEMARK OFFICE

CERTIFICATE OF CORRECTION

PATENT NO. : 6,668,873 B1
DATED : December 30, 2003
INVENTOR(S) : Mark S. Wertheim It is certified that error appears in the above-identified patent and that said Letters Patent is hereby corrected as shown below:

Column 12,
Line 49, change “lockble” to -- lockable --.

Column 15,
Line 15, change “fee-throughs” to -- feed-through --.

Column 16,
Line 2, change “has” to -- hasp --.

Signed and Sealed this

Twelfth Day of April, 2005

JON W. DUDAS
*Director of the United States Patent and Trademark Office*